United States Patent [19]

Ramsey

[11] 3,955,218

[45] May 11, 1976

[54] SELF-VENTING TANK VALVE FOR TOILET TANKS

[76] Inventor: Jerrold Craig Ramsey, 2820 Airport Road, Colorado Springs, Colo. 80910

[22] Filed: Apr. 7, 1975

[21] Appl. No.: 565,954

[52] U.S. Cl. ..... 4/56; 4/57 P; 4/67 A

[51] Int. Cl.[2] ..... E03D 1/34

[58] Field of Search ..... 4/57 P, 67 R, 57 R, 4/67 A, 56, 52

[56] References Cited

UNITED STATES PATENTS

| | | | |
|---|---|---|---|
| 2,511,545 | 6/1950 | Roselair | 4/56 |
| 2,752,608 | 7/1956 | Schneider | 4/57 R |
| 2,830,302 | 4/1958 | Nelson et al. | 4/57 P |
| 3,086,218 | 4/1963 | Gross | 4/56 |
| 3,320,622 | 5/1967 | Wustner | 4/67 R |
| 3,590,395 | 7/1971 | Wustner | 4/56 |
| 3,707,733 | 1/1973 | Gore et al. | 4/57 P |
| 3,733,618 | 5/1973 | Wiegand | 4/57 R |

*Primary Examiner*—Henry K. Artis

[57] ABSTRACT

Disclosed herein is a tank valve for tank-type toilets comprised of a closed upper portion adapted to extend across the opening of a valve seat, and a hollow lower portion extending downwardly from adjacent the upper portion and adapted to extend within the opening of the valve seat. The lower portion is provided with a vent hole to permit air to escape therefrom to counteract the normal buoyancy of the tank valve. Such an arrangement allows the tank valve to close and terminate the flush without having to utilize the entire supply of flush water contained in the toilet tank.

9 Claims, 6 Drawing Figures

SELF-VENTING TANK VALVE FOR TOILET TANKS

BACKGROUND OF THE INVENTION

This invention relates to tank valves for tank-type toilets and more particularly to a tank valve adapted to regulate and minimize the amount of water utilized in flushing.

Conservation of water has become recognized as of late to be of considerable importance, especially in urban areas. While perhaps this concern was precipitated in recent years by extended periods of drought, the concern with water conservation is now recognized as an ever-present one in conjunction with a general spirit of conservation of all natural resources.

A major source of over-consumption of water is the tank-type toilet which is used almost universally. The tank of a tank-type toilet provides a reservoir of water typically 5 to 8 gallons. Such toilets contain a tank valve which sits upon a valve seat disposed in the exit port at the bottom of the tank. When the toilet lever is manually actuated, the tank valve is lifted off the valve seat permitting the water in the tank to drain through the exit port to the toilet. The tank valve is designed to contain an air pocket and therefore remains open during flushing/draining due to the buoyancy resulting from the air pocket. Thus the valve resists closure despite the downward movement of the water level in the tank. It is not until the water level drops to a level adjacent the valve seat that the tank valve, now without water to buoy it, drops back in place over the valve seat, thereby closing the exit port. A float attachment in the tank being downwardly displaced as the water level recedes with flushing, actuates a water inlet valve which fills the tank with water. Return of the float to a predetermined position, caused by the rising water level in the tank, closes the inlet water valve.

It is known, however, that satisfactory toilet operation does not in most cases, especially where simply liquid waste is involved, require flushing with the full complement of water contained in the toilet tank. Hence, water conservation can be practiced by regulating the amount of water used in flushing. Of course, when solid waste is involved, it is desirable to then employ the full tank of water during flushing.

To this end, there have been a number of prior art devices attempting to achieve regulating flushing. Thus, for example, U.S. Pat. No. 3,733,618 to Weigand, issued May 22, 1973 utilizes a check valve on the flush valve for bleeding air therefrom and thereby hasten its closure of the valve seat. Similarly, U.S. Pat. No. 3,858,250 to Coglitore, issued Jan. 7, 1975, describes a plastic tube for bleeding air from the tank valve to a point above the water level in the tank; U.S. Pat. No. 2,883,675 to Hartman, issued Apr. 28, 1959, describing a flush tank valve whose byoyancy can be regulated; and U.S. Pat. No. 2,940,084 to Fabbi, et al., is issued June 14, 1960, describing a double flush valve assembly.

Examples of tank valves may be found in U.S. Pat. No. 2,015,614 to Burnes, issued Sept. 24, 1935; U.S. Pat. No. 3,086,218 to Gross, issued Apr. 23, 1963; and U.S. Pat. No. 3,187,348 to Gresham, issued June 8, 1965. In the patent to Gross there is disclosed a ball-type tank valve having a ⅛-inch hole in the stem thereof to provide stability to the valve to insure proper seating of the valve in the valve seat after complete flushing. In the Burnes Patent, a bulb-type valve is described having an air escape port therein to permit the valve to be weighted with water by the time the tank water has almost run out so as to obtain proper seating of the valve.

The prior art methods and devices for operating tank-type toilet to regulate the amount of water used in flushing suffer from the disadvantage of being relatively complicated and/or requiring substantial alteration of the tank valve assembly or the linkage used in manual actuation thereof.

SUMMARY OF THE INVENTION

It is accordingly the primary object of this invention to provide a tank valve which selectively permits flushing without the need for using the entire complement of water contained in the toilet tank.

A further object is to provide such a tank valve of simple construction and easily adapted to conventional tank-type toilets.

A still further object is to provide such a tank valve wherein the bouyancy of the valve is easily controlled to permit flushing with less than all of the tank water.

In accordance with this invention, a tank valve for use in a conventional tank-type toilet having an exit port at the bottom thereof and a valve seat with an opening therein for connecting the interior of the tank to the exit port is comprised of a closed upper portion and a lower portion having a cavity therein. The closed upper portion is adapted to extend across the valve seat with a predetermined appropriate surface area adapted to face the valve seat and close the opening in the valve seat when engaged therewith. The lower portion extends downwardly from adjacent the predetermined surface area and is adapted to extend within the opening of the valve seat. The lower portion has a downwardly facing opening at the bottom thereof in communication with the cavity and the cavity is of a size such that when substantially filled with air it provides a buoyancy force to the valve, when opened with respect to the valve seat, sufficient to delay the descent of the valve for a period during which water can be substantially emptied from the tank.

The lower portion has a vent hole in its surface extending into the cavity which is adapted to vent air outwardly from the cavity. The hole is located at a predetermined distance above the downwardly facing opening in the lower portion such that, as air is vented from the cavity, sufficient water enters the cavity to reduce the buoyancy of the valve and permit it to descend and close the opening in the valve seat before the tank has emptied, e.g., while the valve is still surrounded by water.

Once this position of the vent hole in the cavity is established, of course, the position of the hole can be made anywhere further away or above the opening in the bottom of the lower portion. A preferred position is one substantially the furthest distance above the opening. Where the upper portion contains a flange around the perimeter thereof, the vent hole can be placed at the interconnection of the flange with the lower portion.

The vent hole can be made at an angle with respect to the bottom portion if desired. In one embodiment of this invention the hole is made at an angle such that when the valve is opened with respect to the valve seat the vent hole is in a horizontal direction relative to the water level in the tank. The use of an angular hole is designed to afford the least impeded route for air expelled from the valve cavity.

The rate at which air is expelled from the cavity determines the duration of the time that the valve is open and, therefore, the amount of water allowed to drain before re-closure. The rate of expelling air is determined by the size of the vent hole provided in the lower portion of the valve. This size, of course, may be widely varied according to any desired predetermined amount of water required for flushing.

The tank valve is manually actuated and removable from the valve seat by a chain and lever connected thereto which lever is usually connected to a handle external of the tank. The valve may be further connected to a pipe in the toilet tank, typically the overflow pipe, by suitable hinges which allow for movement of the valve away from and toward the valve seat. Such valves are well-known in the art as "flapper valves."

Where it it desired to completely drain the tank water during flushing, e.g, for solid disposal, it is merely necessary to maintain and hold the external handle in whatever position causes the tank valve to assume a position above the valve seat until the draining is complete. The manual force thus serves to counteract the normal urge, as a result of venting, for the tank valve to close.

This self-venting of the tank valve can be seen to permit closure of the exit port prior to complete draining of the toilet tank; in contrast, the standard tank valve, due to its buoyancy resulting from the unreleased air pocket within the cavity, with not close until the water lever in the tank recedes to the valve seat.

DESCRIPTION OF THE PREFERRED EMBODIMENTS

Figure 1:
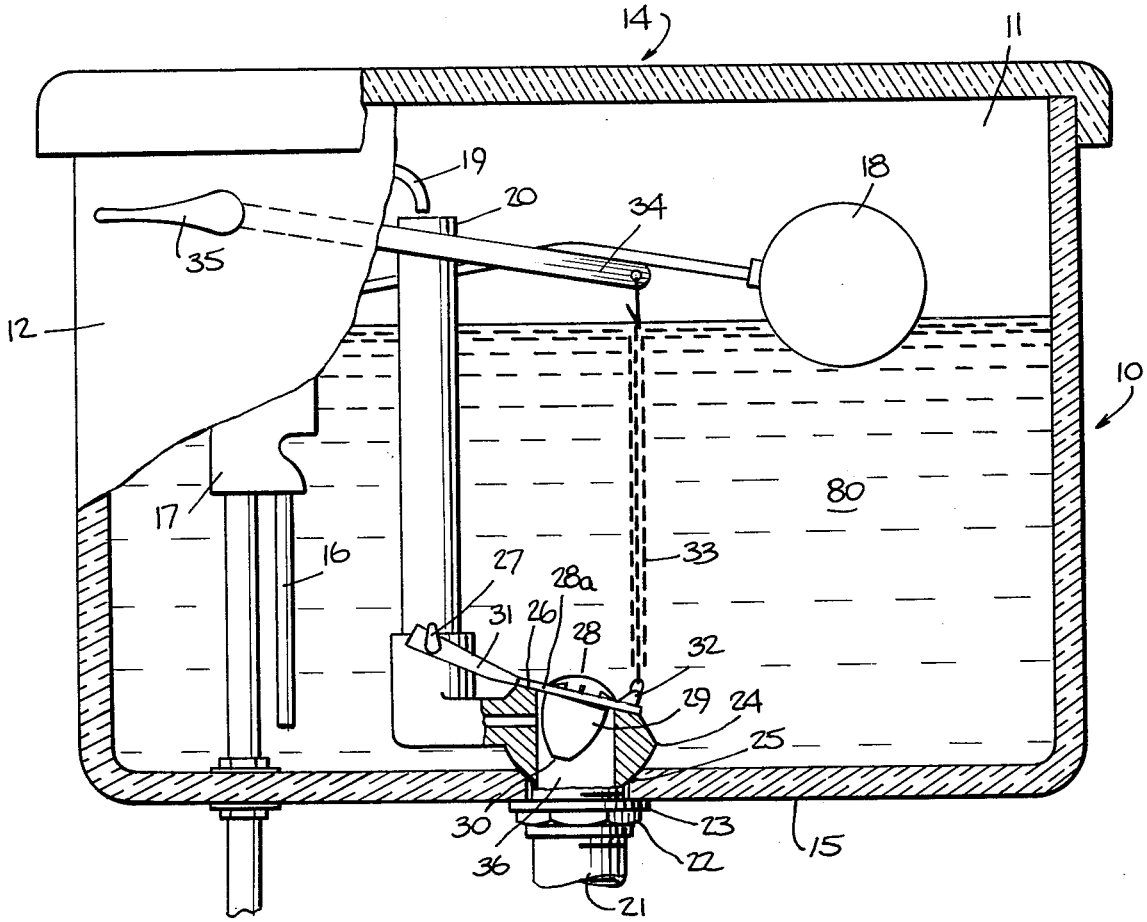
FIG. 1 is a vertical sectional view of a toilet tank having the vented tank valve of the invention mounted therein.

With reference to FIG. 1, a typical conventional toilet tank 10 is shown. The tank has a rear wall 11, a front wall 12, side walls 13, a removable top 14 and bottom wall 15. Located within the tank is a water supply 16 and a water supply valve 17 controlled by float 18 in a known manner. Tube 19 extends down into or slightly above overflow pipe 20.

Delivery pipe 21 is connected to the toilet bowl (not shown) and is connected by a suitable coupling 22 and washer 23 to the valve seat 24 which is in the outlet opening 25 in the bottom wall 15 of tank 10.

Tank valve 26 is of the flapper-type and is connected to overflow pipe 20 at hinges 27 by any known means. The tank valve comprises an upper portion 28, and lower portion 29 which is hollow and has a downwardly directed opening 30 at the base thereof. Upper portion 28 has a flange **28*a* around the perimeter thereof and appropriate levers 31 to engage hinges 27 and thereby allow pivotal movement of tank valve 26 around the hinges. Upper portion 28 has means 32 thereon to connect with chain 33. Chain 33 is connected to lever arm 34 which is actuated by flush handle 35 on the front wall 12 of tank 10**.

In operation, flush handle 35 is raised or depressed (depending upon the particular linkage system utilized) to raise lever 34 so as to raise tank valve 26 to a position above valve seat 24 and thereby open exit port 36. Water 80 exits tank 10 through exit port 36 and through delivery pipe 21. In conventional flapper tank valve operation, the air contained in the cavity of the valve causes the valve to be buoyed in surrounding water 80 as the water flows out of the tank. As a result, the conventional valve remains open until the water recedes to a level near the valve seat at which point the valve is no longer supported by its buoyancy and descends and seats on the valve seat and closes the exit port.

As the water level drops in tank 10, float 18 descends and opens water inlet valve 17, and after tank valve 26 closes the exit port, water refills the tank from delivery pipe 16 until float 18 returns to a pre-determined position.

Figure 2:
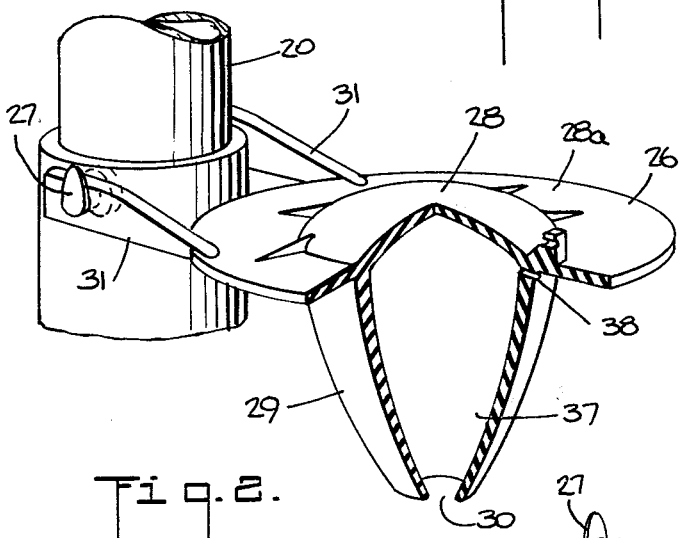
FIG. 2 is a fragmentary perspective partly in section of a flapper-type tank valve having hole vent means therein.

Referring to FIG. 2, there is shown tank valve 26 of the invention. As shown, the tank valve is of the flapper-type and has an upper portion 28 adapted to cover and close the valve seat with a predetermined surface area. Adjacent to this surface is lower portion 29 adapted to extend within the valve seat. Upper portion 28 is shown with a flange **28*a*** around the perimeter thereof.

Tank valve 26 has appropriate lever arms 31 adapted to engage hinges 27 and thereby allow pivotal movement of the tank valve 26 about the hinges. Hinges 27 are shown here as attached by appropriate means to overflow pipe 20.

Lower portion 29 is hollow and therefore contains cavity 37 therein. Opening 30 defines the entrance to the hollow portion or cavity 37 and is located at the base of the lower portion 29. Lower portion 29 contains a vent hole 38 in the surface extending through the wall of the valve into cavity 37. The size and position of vent hole 38 is discussed hereinafter.

Figure 4:
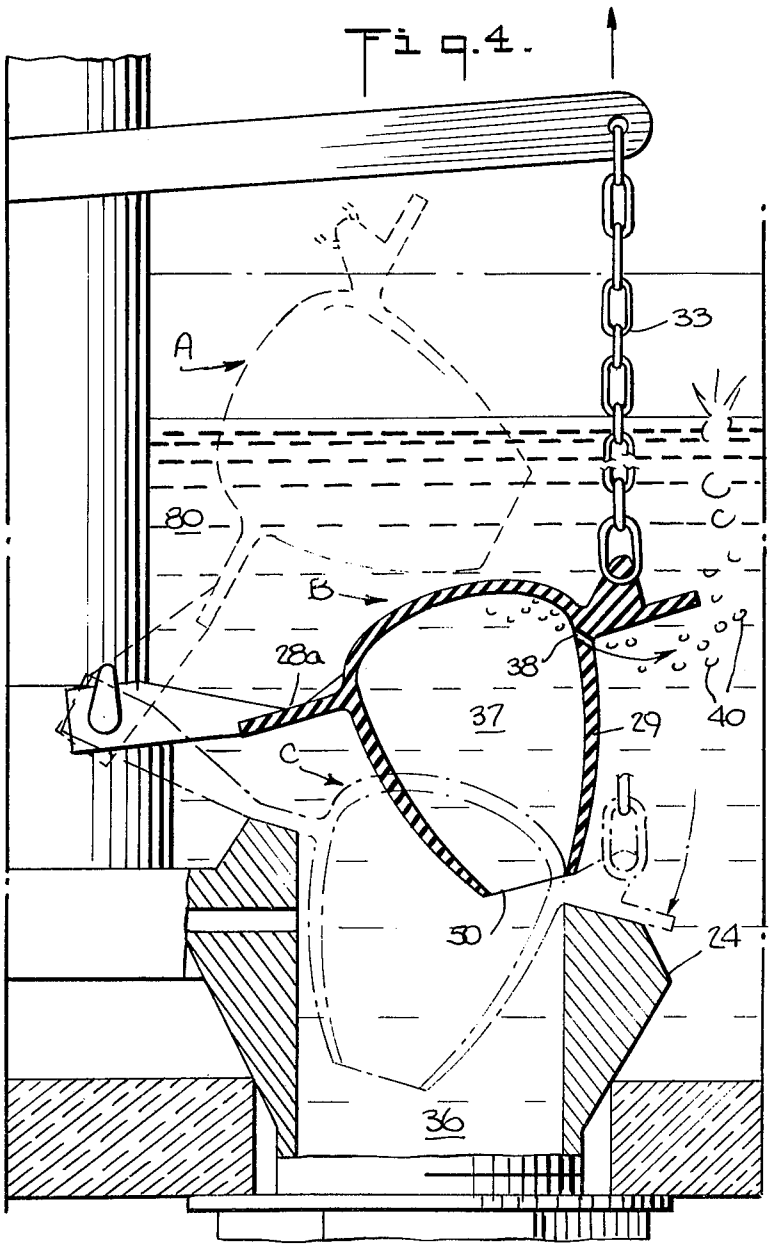
FIG. 4 is a vertical section view showing a toilet tank, containing the tank valve of the invention, during flushing.
Figure 3:
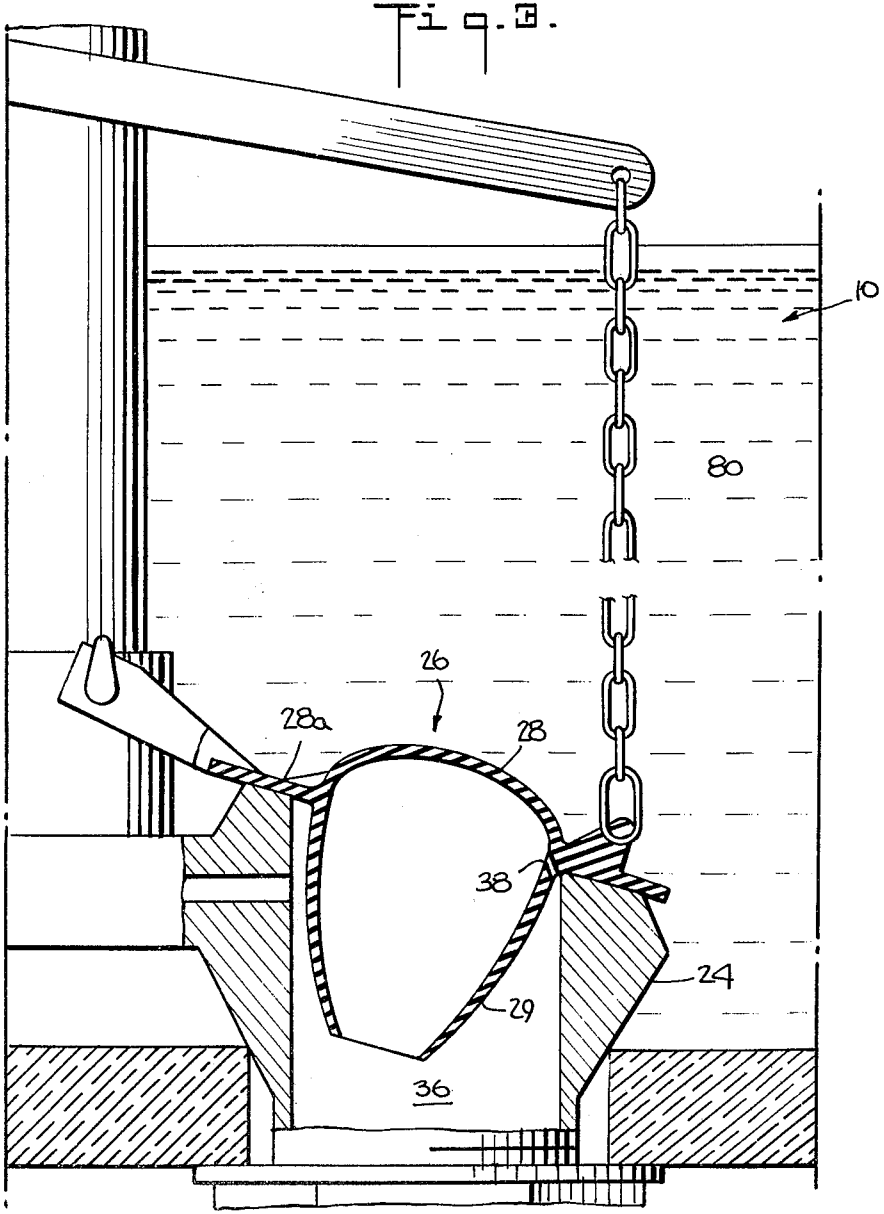
FIG. 3 is a vertical section view of a full toilet tank with the tank valve in a closed position.

FIGS. 3 and 4 illustrate the operation and utility of the present invention. FIG. 3 shows conventional tank 10 with a full complement of water 80 wherein. Tank valve 26 is shown containing vent hole 38 in lower portion 29. Thus, prior to flushing, lower portion 29 sits within seat valve seat 24 and within exit port 36. Upper portion 28 rests over valve seat 24 to close it and prevent water from exiting through port 36.

As shown in FIG. 4, manual actuation of the flush handle causes lever 34 to rise. Chain 33 attached thereto and attaching means 32 located on tank valve 26 causes the valve to rise to a pre-determined position above valve seat 24 as shown by the dotted-line valve A. Water 80 begins to drain through exit port 36. With a conventional toilet, the tank valve contains air trapped in the cavity of the valve which keeps the valve buoyant until all the water drains from the tank. The present invention enables air 40 to be vented in a controlled manner from cavity 37 through vent hole 38 to reduce the buoyant forces progressively. In this manner tank valve 26 is caused to drop as shown by the solid-valve B and engage and close valve seat 24 even while tank valve 26 remains in surrounding water. This final seated position is shown by valve C. Thus, flushing is achieved without being required to utilize all the water contained in the tank 10.

The position of vent hole 38 relative to the opening 30 in the bottom of lower portion 29 is determined according to the following criteria. The vent hole 38 is placed in a position such that a sufficient amount of air contained in cavity 37 is expelled or vented therefrom to reduce the buoyancy of the valve to an extent which enables tank valve 26 to drop and engage valve seat 24 while still in surrounding water which would otherwise buoy the tank valve, i.e., before the tank empties. Thus, the position of vent hole 38 in the surface of lower portion 29 is determined by the extent of flooding of the cavity of the valve that is required to cause the valve to close prematurely.

Once a position of vent hole 38 is established which causes premature closing of the valve other positions which enable additional venting can also be utilized. As shown in FIG. 4, the axis of the vent hole in the initial stage of flushing (dotted-line valve A) can be positioned such that the venting of air from the cavity is facilitated. That is, the angle with respect to the central axis of the valve is such that the vent hole faces in a substantially horizontal direction.

The size of vent hole 38 is varied to control the rate at which air is bled or vented from cavity 37 and accordingly the time period for discharge of water from the tank. Thus the size will determine how much water is allowed to drain from tank 10 before the tank valve closes over exit port 36. Typically, the size is chosen to allow only one-half the water in the tank to drain in a standard flush. To empty more than this amount it is merely necessary to actuate and maintain the flush handle so as to keep the tank valve 26 raised for a period of time sufficient to enable all of the water to leave the tank.

In a conventional toilet tank a total time of about 8–10 seconds is needed to drain the contents of tank 10. Thus, by way of example, the hole size could be selected to cause a partial flush by shortening the valve cycle to be about 4–5 seconds. This of course would result in about only one-half the water content of tank 10 being discharged. In a typical flapper-type valve having a conical or tapering float member of about 1 ¾ inches in length and tapering cavity diameter of 1 ½ inches, a vent hole, by way of example, having a diameter of about thirty-one thousandths (0.031) of an inch will permit closure in about 4 to 5 seconds. Lower portion 29 may of course contain a plurality of vent holes to achieve the desired rate of bleed. The tank valve 26 may be made of any material suitable for toilets, but is typically made from a rubber-like material or soft plastic material.

Figure 5:
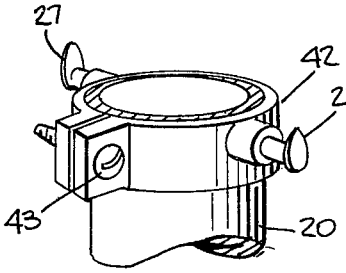
FIG. 5 is a fragmentary perspective view of an adapter means for converting conventional toilets for use with a vented tank valve of the invention.

FIG. 5 shows an adapter means 41 which can be fitted over overflow pipe 20 and to which a tank valve of this invention of the flapper-type can be attached thereto at hinges 27 to become pivotally movable thereon. Adapter means comprises a resilient ring member 42 which is threadably tightened by screw 43.

Figure 6:
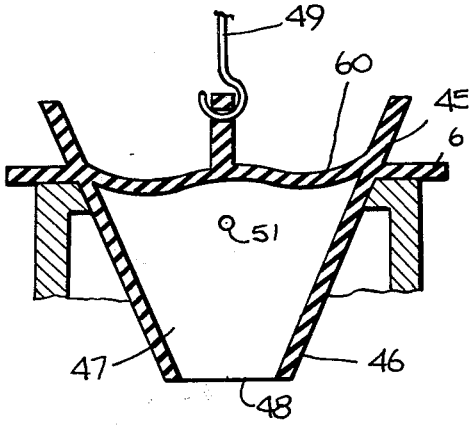
FIG. 6 is a vertical section view of another embodiment of the tank valve of the invention.

FIG. 6 shows an embodiment of this invention wherein the tank valve 44 is a modified ball-type valve as opposed to a flapper-type tank valve. The tank valve is comprised of a hollow body portion 160 shown with a flat flange perimeter 61 which essentially divides the body portion into an upper portion 45 and a lower portion 46. The valve contains a cavity 47 therein opening at the base of lower portion 46 at opening 48. Means are attached to the top of the tank valve to which a chain 49 or other suitable lifting connection can be attached. Vent hole 51 is located on the surface of lower portion 46 and extends into cavity 47 to allow air to be vented therefrom. It will be noted that upper portion 45 as shown contains only a minimal void or hollow area. It is found that in modifying conventional ball valves it is generally not possible to place the vent hole high enough in the lower portion to vent sufficient air, and hence permit sufficient water to enter cavity 47, to close the valve prematurely, i.e., before the water in the tank is drained. This owes generally to the larger void volume of such valves. Hence in a preferred embodiment for such valves it is desirable to decrease this overall void volume such that a vent hole in the lower portion can permit premature closing of the valve. As shown, this can be accomplished by constructing the tank valve so as to eliminate the void volume in the upper portion. Typically, flooding (caused by venting air from the cavity) approaching 90% of the volume of the tank valve cavity is necessary to cause premature closing. Since in conventional ball-type valves this would require a vent hole in the upper portion it is therefore preferred to construct the valve such that the predominant void volume resides in the lower portion, i.e., the portion which is adapted to extend within the opening of the valve seat.

In a preferred emboidment of a tank valve of the invention, the vent hole is located at or near the underside intersection of the lower portion and the flange surroudning upper portion such as shown in FIG. 2. The upper portion, of course, serves to prevent water from entering through the vent hole while the tank valve is closed.

The invention further comprises a method for adapting conventional tank valves to permit premature closure thereof by placing a hole in the lower hollow portion of the valve as described herinabove with respect to the valve itself.

Thus the present invention can be seen as providing a simple yet highly effective device for regulating and limiting the amount of water utilized in flushing a tank-type toilet. As such, this tank valve can lead to a significant conservation, and savings, of domestic water supplies, especially in those areas where water is limited. In contrast to prior art devices having a similar purpose, the tank valve of this invention is unique in that the means for expelling the air is positioned in a manner whereby there is no fear of water prematurely entering therein nor resort to complicated devices to insure such a condition.

Since flapper-type valves are the most commonly utilized today it will be appreciated that the present invention is ideally suited therefore. The flapper-type valve according to this invention comprises a hollow circular body portion having a downwardly facing opening at the bottom thereof defining the entrance to the cavity. A flat circular flange extends laterally around the perimeter of the body portion. The flange sits on the valve seat to close the opening therein and serves to divide the body portion into upper and lower portions. The lower portion is adapted to extend into the opening in the valve seat when the flange covers the seat. Means are included for pivotally mounting the valve for movement about a predetermined pivotal axis offset from and at an angle to the central axis of the valve. As with non-flapper valves the vent hole is located in this lower portion, preferably adjacent to the interconnection of the lower portion with the underside of the flange to permit premature closing at some predetermined time. As with non-flapper valves, the axis of the vent hole can be disposed at a predetermined angle to the central axis of the valve extending through the upper and lower portions.

While this invention has been described with respect to certain preferred embodiments, it will be appreciated by those skilled in the art that various modifications and alterations may be made without departing from the scope and spirit of this invention as defined by the appended claims.

What is claimed is:

1. A tank valve for use in a tank-type toilet having an exit port at the bottom thereof and a valve seat having an opening therein for connecting the interior of the tank to the exit port, said valve comprising:

a closed upper portion adapted to extend across the opening of the valve seat with a predetermined surface area on said upper portion adapted to face said valve seat for closing the opening in the valve seat when engaged therewith; and a lower portion extending downwardly from adjacent the predetermined surface area of the closed upper portion and adapted to extend within the opening of the valve seat, said lower portion having a cavity therein and a downwardly facing opening adjacent the bottom of the lower portion of the valve in communication with the cavity, the cavity when substantially filled with air providing a buoyancy force to the valve when said valve is opened with respect to the valve seat sufficient to delay the descent of the valve until water is substantially emptied from the tank; said lower portion having a vent hole extending from the outer surface thereof to the cavity therein and adapted to vent air outwardly from the cavity, the position of the vent hole at the outer surface of the lower portion being below the predetermined surface area of the closed upper portion and at a predetermined distance above said opening in the lower portion and enabling sufficient water to enter the cavity as air is vented therefrom to reduce the buoyancy of the valve such that the valve will descend and close the opening in the valve seat before the water in the tank has emptied.

2. A tank valve in accordance with claim 1 wherein the vent hole is located in said lower portion substantially the furthest distance above the opening in the lower portion.

3. A valve in accordance with claim 1 wherein said upper portion further includes a flange extending laterally around the complete perimeter thereof, the flange having a bottom laterally extending surface facing the lower portion of the valve, and wherein said vent hole is located adjacent the interconnection of said flange and the lower portion of the valve.

4. A valve in accordance with claim 1 and further comprising means for pivotally mounting the valve for movement about a pivotal axis offset from and at an angle to the central axis of the valve, the mounting means enabling the valve to operate as a flapper valve, and in which the axis of the vent hole is disposed at a predetermined angle to the central axis of the valve extending through the upper and lower portion thereof such that when the valve is opened with respect to the valve seat the vent hole faces in a substantially horizontal direction to facilitate the venting of air from the cavity.

5. A valve in accordance with claim 1 wherein the vent hole is of a predetermined size which causes the rate of air vented therefrom to be sufficient to reduce the buoyancy of the valve and thereby cause the valve to close the opening in the valve seat in a time less than that required for the water in the tank to completely drain therefrom.

6. A valve in accordance with claim 5 wherein the predetermined size of the vent hole results in a rate of air vented therefrom to cause the valve to close the opening in the valve seat after about one-half the water in the tank has drained therefrom.

7. A valve in accordance with claim 6 wherein the vent hole is in the range in the vicinity of about 0.031 inches in diameter.

8. A tank valve of the flapper type for use in a tank-type toilet said toilet having an exit port at the bottom thereof and a valve seat having an opening therein for connecting the interior of the tank to the exit port, said valve made of flexible material and comprising:

a circular hollow body portion having a cavity therein and a downwardly facing opening adjacent the bottom of the body portion in communication with the cavity, the cavity when substantially filled with air providing a buoyancy force to the valve when the valve is opened with respect to the valve seat sufficient to delay the descent of the valve until water is substantially emptied from the tank;

a circular flat flange extending laterally around the the complete perimeter of said body portion, the bottom surface of said flange adapted to face the valve seat for closing the opening in the valve seat when engaged therewith, said flange dividing the body portion into upper and lower portions, said lower portion adapted to extend within the opening in the valve seat;

means for pivotally mounting the valve for movement about a pivotal axis offset from and at an angle to the central axis of the valve; the lower portion of said hollow body having a vent hole located substantially adjacent the interconnection of said flange and said lower portion, the vent hole extending from the outer surface of the lower portion to the cavity therein and adapted to vent air outwardly from the cavity such that sufficient water enters the cavity as air is vented therefrom to reduce the buoyancy of the valve such that the valve will descend and close the opening in the valve seat before the entire water in the tank has drained therefrom.

9. A tank valve of ball-type for use in a tank-type toilet, said toilet having an exit port at the bottom thereof and a valve seat having an opening therein for connecting the interior of the tank to the exit port, said valve comprising:

a circular hollow body portion having a cavity therein and a downwardly facing opening adjacent the bottom of the body portion in communication with the cavity, the cavity when substantially filled with air providing a buoyancy force to the valve when the valve is opened with respect to the valve seat sufficient to delay the descent of the valve until water is substantially emptied from the tank;

a circular flat flange extending laterally around the complete perimeter of said body portion, the bottom surface of said flange adapted to face the valve seat for closing the opening in the valve seat when engaged therewith, said flange dividing the body portion into upper and lower portions, said lower portion adapted to extend within the opening in the valve seat; said upper and lower portions constructed such that at least about 90% of the total void volume of said cavity resides in the lower portion;

means for lifting the valve to a position above said valve seat; the lower portion of said hollow body having a vent hole located substantially adjacent the interconnection of said flange and said lower portion, the vent hole extending from the outer surface of the lower portion of the cavity therein and adapted to vent air outwardly from the cavity such that sufficient water enters the cavity as air is vented therefrom to reduce the buoyancy of the valve such that the valve will descend and close the opening in the valve seat before the entire water in the tank has drained therefrom.

* * * * *

UNITED STATES PATENT AND TRADEMARK OFFICE

CERTIFICATE OF CORRECTION

PATENT NO. : 3,955,218
DATED : May 11, 1976

INVENTOR(S) : Jerrold Craig Ramsey

It is certified that error appears in the above–identified patent and that said Letters Patent are hereby corrected as shown below:

Col. 1, line 48, "regulating" should be --regulated--;

Col. 1, line 57, "byoyancy" should be --buoyancy--;

Col. 1, line 58, delete "is" at end of line;

Col. 2, line 22, "bouyancy" should be --buoyancy--;

Col. 3, line 19, second "it" should be --is--;

Col. 3, line 31 "with" should be --will--;

Col. 4, line68, "solid-"should be --solid-line--;

Col. 5, line 66, "160" should be --60--;

Col. 6, line 33, "surroudning" should be --surrounding--;

Col. 6, line 40, "herinabove" should be --hereinabove--;

Col. 6, line 56, "therefore" should be --therefor--;

Col. 10, line 4, "portion of the" should be -- portion to the --.

Signed and Sealed this

Thirty-first Day of August 1976

[SEAL]

*Attest:*

RUTH C. MASON
*Attesting Officer*

C. MARSHALL DANN
*Commissioner of Patents and Trademarks*